United States Patent [19]

Sharp

[11] Patent Number: 4,781,401

[45] Date of Patent: Nov. 1, 1988

[54] ADJUSTABLE JACK FOR MOUNTING ON A DUCT BEND

[75] Inventor: Donald W. Sharp, Phoenix, Ariz.

[73] Assignee: Reynalda Clack, Phoenix, Ariz.

[21] Appl. No.: 50,082

[22] Filed: May 15, 1987

[51] Int. Cl.[4] ..... F24F 13/02

[52] U.S. Cl. ..... 285/44; 285/42; 285/155; 285/424; 98/39.1

[58] Field of Search ..... 285/43, 44, 184, 424, 285/155, 179, 188, 42; 98/39, 42.02; 138/DIG. 8

[56] References Cited

U.S. PATENT DOCUMENTS

| | | | |
|---|---|---|---|
| 559,305 | 4/1896 | Nies | 285/44 X |
| 1,370,199 | 3/1921 | Downs | 285/43 |
| 1,704,942 | 3/1929 | Hopson | 285/44 |
| 1,804,954 | 5/1931 | Rutherford | 285/424 X |
| 1,908,821 | 5/1933 | Cornell, Jr. | 285/155 X |
| 2,216,864 | 10/1940 | Wasmund | 285/424 X |
| 2,736,949 | 3/1956 | Kraemer | 285/155 X |
| 3,742,659 | 7/1973 | Drew | 285/44 X |
| 4,526,091 | 7/1985 | Sharp | 285/44 X |

FOREIGN PATENT DOCUMENTS

| | | | |
|---|---|---|---|
| 751895 | 9/1933 | France | 285/44 |
| 300545 | 4/1968 | Sweden | 285/155 |

*Primary Examiner*—Randolph A. Reese
*Assistant Examiner*—Anthony Knight
*Attorney, Agent, or Firm*—M. David Shapiro

[57] ABSTRACT

The invention comprises an economical, adjustable duct section which allows an installer to mount and connect a curved end thereof to an opening in an air duct bend and to adjust the other end to a desired predetermined angle with respect to the horizontal. The invention makes it more feasible to install a second air handler on an outlet duct bend of a first air handler for augmenting an output of the first air handler on the roof of a building or the like. It provides an easily made water and weather tight seal between the assembled units.

4 Claims, 1 Drawing Sheet

ADJUSTABLE JACK FOR MOUNTING ON A DUCT BEND

FIELD OF THE INVENTION

The invention relates to an adjustable duct jack for mounting on a duct bend, such as the bend which may be utilized to connect a roof mounted air conditioner, or the like to the interior ducting of a building upon which the air conditioner is mounted.

BACKGROUND OF THE INVENTION

My U.S. Pat. No. 4,526,091 for an "Adjustable Roof Jack," issued on July 2, 1985, describes and cIaims an adjustable roof jack which may be used to connect a roof mounted air handler to an interior air duct through a roof of a building, wherein the roof pitch may be within a wide range of angles from the horizontal; from horizontal to approximately a 5/12 slope. Because the jack there described may accommodate such a wide range of roof slopes, it has enjoyed a substantial degree of commercial success.

In some parts of the world, it is feasible to utilize evaporative coolers in lieu of mechanical air conditioning systems which are more expensive to operate. In many of these locations, it may be feasible to utilize an evaporative cooler in those seasons of the year when there is a low ambient humidity; but when the percentage of humidity rises, it is advantageous to switch to evaporator-compressor-condenser (refrigeration) systems. Therefore, it is the practice in some climates to use what has come to be known as "piggyback" systems.

In such a system, facilities are provided so that either a refrigeration unit or an evaporative cooler may be utilized as the cooling source, both units being roof mounted and capable of being switched into a common supply duct to a building duct system, below. Generally, this switching is accomplished by inserting a sheet metal plate into the duct system at an appropriate point (or points) to isolate the air outlet of the unused unit.

Because roof mounted refrigeration units are frequently installed so that cold air is delivered from one vertical side thereof, a ninety degree sheet metal duct bend is employed to carry the air downward to a roof level connection with the interior duct system. While the radius of a given air conditioning supply bend is subject to some variation, the majority of them use a bend which is designated in the industry as a 1½ inch per foot bend.

It is common practice to gain access to the common duct system for an add-on evaporative cooling system by cutting a hole in the bend of the air conditioning supply duct and custom manufacturing a sheet metal duct attachment thereto into which the outlet of the evaporative cooler is led by means of the specially fabricated sheet metal duct work. A metal slide is then employed to block the outlet of the evaporative cooler during those seasons when the cooler is not in use. However, because it is important that the evaporative cooler be mounted parallel to the horizon so that the water in the sump is level, each of these applications must be designed and fabricated to fit the particular configuration encountered in each retrofit job.

SUMMARY OF THE INVENTION

These and other problems with prior art inventions are resolved by means of the instant invention in which the adjustable roof jack of my previous U.S. Pat. No. 4,526,091 is fitted with a curved base member which accommodates the curve of standard sheet metal bends used to connect roof mounted air conditioners to a building supply duct at the roof line. The base member of the instant invention may be employed to attach an evaporative cooler to the standard 1½ inch per foot bend of an existing (or new installation) air conditioner supply duct and the adjustable feature, as described in my U.S. Pat. No. 4,526,091 patent, may be used to level the inlet end of the attachment duct so that the evaporative cooler may be set level.

It is, therefore, an object of the invention to provide an adaptive adjustable angle duct means for connecting a second air supply means to a duct bend used to supply a first air source to a building inlet ducting system.

It is another object of the invention to provide an adaptive adjustable angle duct means for connecting a second air supply means to a duct bend used to supply a first air source to a building inlet ducting system wherein the adaptive means incorporates a curved base configuration for facilitating connection to the duct bend.

It is still another object of the invention to provide an improvement to an adjustable angle roof jack comprising an adaptive duct means for connecting the roof jack to a curved inlet duct of a first air source wherein a second air supply means may be attached to a duct bend used to supply a first air source to a building inlet ducting system.

These and other objects of the invention will be more readily understood upon study of the Detailed Description of the Preferred Embodiment of the Invention, below, taken together with the drawings, in which.

DETAILED DESCRIPTION OF THE PREFERRED EMBODIMENT OF THE INVENTION

My U.S. Pat. No. 4,526,091 is hereby incorporated herein by this reference thereto.

Figure 1:
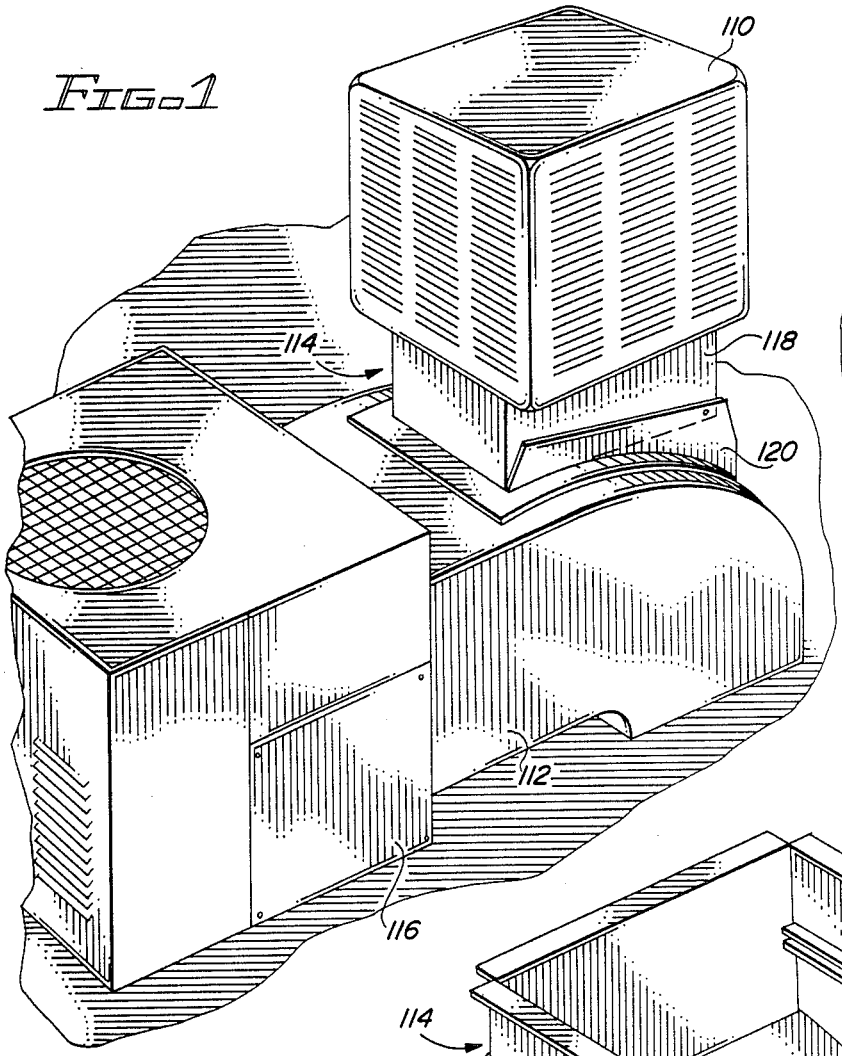
FIG. 1 is an overall view of the adjustable angle adaptive duct of the invention as it appears in use, attached to the curved bend cold air inlet supply duct of a roof mounted air conditioning unit and showing an evaporative cooler mounted thereon.

An overall view of the device of the invention is illustrated in FIG. 1 where it will be seen that an evaporative cooler 110 is mounted above and attached to an upper two dimensional curved side of an elbow bend 112 of a rectangular distribution outlet duct of air conditioner 116 by means of adjustable adaptive duct section 114.

Figure 4:
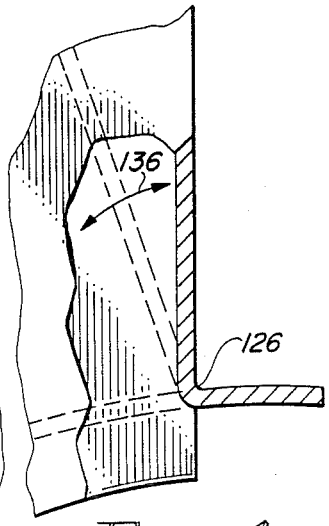
FIG. 4 is a detailed view of the duct of the invention taken from circle 4 of FIG. 3.

Adaptive section 114 comprises an upper section 118 and a lower section 120. (Sections 118 and 120 have a common sheet metal portion which forms the surfaces adjacent bend line 126, see, FIGS. 3 and 4.) Evaporative cooler 110 is a down draft model which delivers its air supply downward from its base into adaptive section 114, and then, to refrigeration unit 116 outlet duct bend 112.

Figure 2:
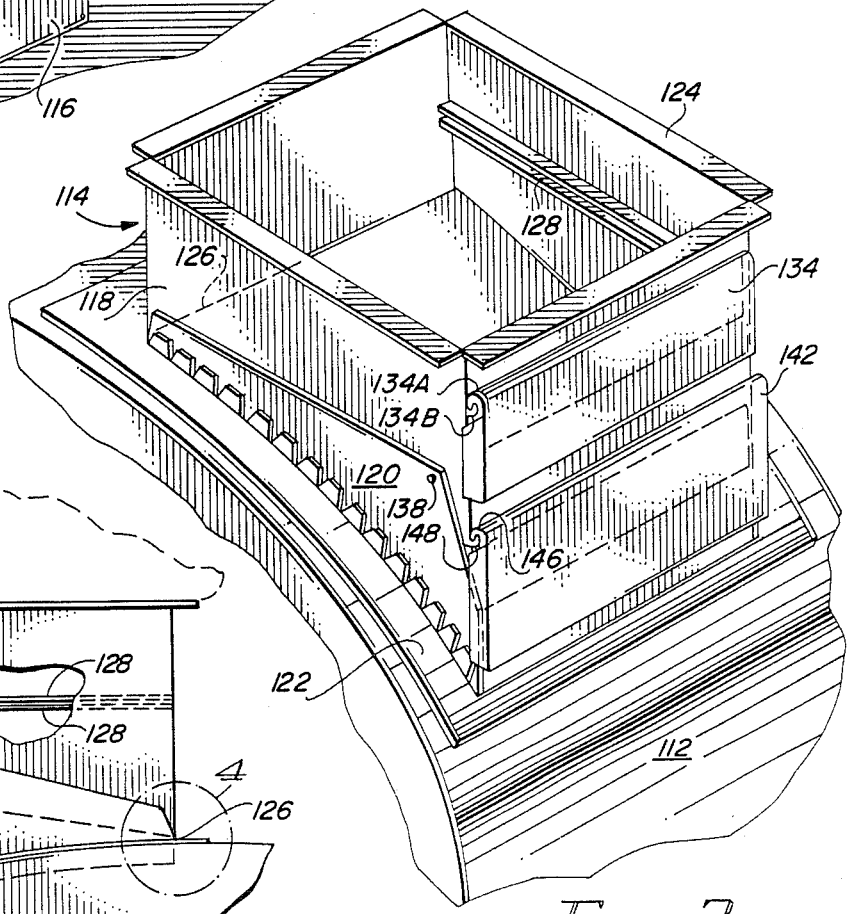
FIG. 2 is a three-quarter view of the adaptive duct of the invention shown mounted on a section of duct bend.

FIG. 2 illustrates a preferred embodiment of the adjustable roof jack 114 of the invention in more detail. Lower section 120 has flange portion 122 which surrounds the lower portion of section 120 and is perpendicular to each of the three walls which comprise lower duct section 120. Flange 122 has two parallel curved flange portions whose curve matches the industry standard 1½ inch per foot curvature for duct bends. Two other flange portions are flat, one being adjacent a third wall of lower section 122 and the other being formed from the same sheet metal that forms the corresponding fourth wall of upper section 118.

Upper section 118 is equipped with upper flange 124. Upper section 118 is joined to lower section 120 by means of a sheet metal bend along edge 126. The bend at edge 126 acts as a waterproof and weatherproof hinge between upper section 118 and the flange portion of lower section 120. The output duct of an air handler or evaporative cooler (see, FIG. 1) fits against flange 124 or within the duct orifice formed at the top of upper section 118. Lower section 120 flange 122 is adapted to be fastened to the bend of duct 112. Flanges 122 and 124 provide an effective flashing for jack 114. It will be understood that upper flange 124 and lower flange 122 serve similar purposes and operate in the same way as similar flanges in prior art devices.

Figure 3:
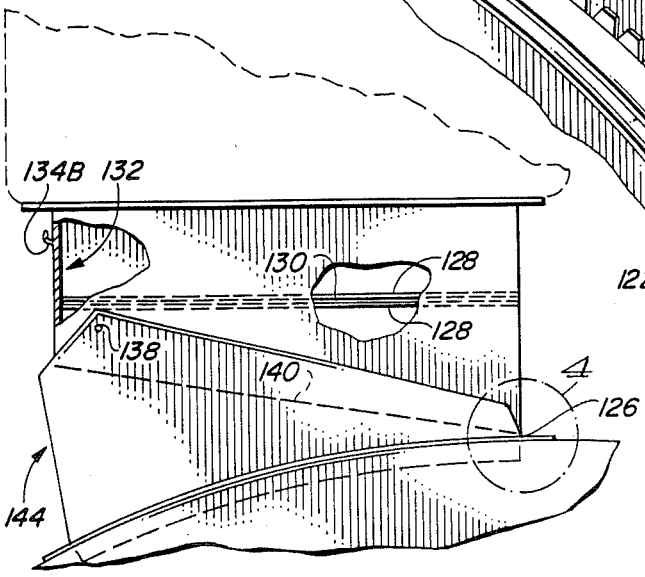
FIG. 3 is a side view of the adaptive duct of the invention mounted on a duct bend.

FIG. 3 illustrates "U" shaped track pair 128 which accommodate slide 130 via access hole 132. Tracks 128 may also be used to support a self contained barometrically operated damper (not shown) which opens automatically when air pressure (indicating an operating air handler) is sensed. As may be seen from FIG. 3, plate 134 may be used to cover access hole 132 after either slide 130 or such a barometric baffle are installed or removed therefrom.

FIG. 3 also illustrates the adjustable feature of jack 114 of the invention. Double ended arrow 136 indicates that the angle between upper section 118 and lower section 120 of jack 114 may be changed and adjusted at the installation site to adapt the angle of jack 114 to the installation site angle. Break line 126 acts as the hinge between the upper and lower sections of jack 114. Once the adjustment is accomplished, self drilling sheet metal screws may be installed in hole 138 (one shown) to lock the two sections 118, 120 with respect to each other and therefor to fix that angle to accommodate the mounting angle as required to level evaporative cooler 110. The design as shown may be adjusted to fit an air handler to any angle lying in the range anticipated due to the variations of duct bend 112, both because of the range of mounting angles encountered on typical roofs and because of the various positions of mounting of adaptive duct 114 on the bend of duct 112.

While the maximum range of adjustment of adaptive duct 114 is limited within the inherent design limits of the preferred embodiment of the invention, it will be obvious to one of ordinary skill in the art that other configurations may be employed which would extend the range beyond that limit. If the lower side walls 140 of upper section 118 were to be made greater in depth, it would not be possible to fit 110 to a nearly flat or zero slope bend. However, it could be extended to fit greater slopes. Additionally, if there were adequate space within duct 112 so that such extension in assembly of the invention, as fully closed (minimum angle) it might then be possible to fit a zero slope installation, even with such upper section 118 side wall 146 extended dimensions Approximate dimensions for key portions of the preferred embodiment of the invention, as shown in the drawings, are as follows:

Width of lower flange 122=1.5 inches.

Minimum height of lower section 120 (near bend 126)=2.25 inches.

Maximum height of bottom section 120 (near screw hole 138)=8.25 inches.

Height of lower section 120 (at front below gap 144)=2.75 inches.

Size of discharge opening=18 inches×18 inches.

FIG. 2 is also illustrative of how plate 142 is used to close gap 144 (see, FIGS. 2 and 3) at the front of the assembly of jack 114 when jack 114 is adjusted to the high end of the range of slopes over which it is effective. Plate 142 has a lip 146 which engages lip 148 of upper section 118 and supports plate 142 in place over opening 144. Similarly, plate 134 has a lip 134A which hooks over lip 134B on upper section 118 of jack 114.

It will be understood by one of ordinary skill in sheet metal work that after the angle of the jack of the invention has been adjusted to the duct bend upon which it is installed and screws 32 have been installed to lock that position, it is necessary to seal the various joints of the jack with a suitable roofing sealant. Plate 134 may be sealed in place by using duct tape if it is required to remove and replace it seasonally. Plate 142 may be permanently sealed in place once the angle of the jack is set.

It may be seen that jack 114 is constructed very much like the roof jack of my U.S. Pat. No. 4,526,091. A modification of the base of that device has been made particularly to accommodate the mounting of the adjustable angle jack on a duct bend, such as duct bend 112. The outlet end of lower section 120 of jack 114 has been shaped to conform to the standard 1½ inch per foot curvature of a typical duct bend as might be utilized to make a connection between an air outlet port of roof mounted refrigeration unit 116 and the roof level inlet to the building duct system. Well known sheet metal working techniques for fabricating and attaching curved flange 122 to lower portion 120 of jack 114 may be utilized for that purpose.

It will be readily understood by those of ordinary skill in the sheet metal design and fabrication art that the detailed design and fabrication of the invention, assembly methods and patterns are well known and need not be described herein since they are well within the capabilities of one of ordinary skill in the art. The specific design utilized to fabricate the invention will depend upon the metal working tools available to the artisan and customary practices within his/her particular fabrication organization. While the preferred embodiment of the invention, as described herein, was fabricated from 26 gauge sheet metal, other applications may require another thickness of metal.

While the invention has been particularly shown and described herein with reference to a preferred embodiment thereof, it will be understood by those skilled in the art that various other modifications and changes may be made to the present invention from the principles of the invention as herein described without departing from the spirit and scope as encompassed in the accompanying claims. Therefore, it is intended in the appended claims to cover all such equivalent variations which may come within the scope of the invention as described.

What is claimed is:

1. An improvement in an adjustable angle adaptive duct section for connecting an air handler to an upper curved side of an elbow portion of a distribution duct, the distribution duct having a rectangular cross section, the adjustable angle adaptive duct section having an inlet end and an outlet end, the inlet and the outlet ends of the adjustable angle adaptive duct section being joined by at least a bendable section, each of the inlet and outlets ends comprising a plurality of walls, the improvement comprising:

means for adapting the outlet end of the adjustable angle adaptive duct section to a portion of said upper curved side of said elbow portion of said rectangular cross section distribution duct, wherein said adaptive means comprises a mounting flange at said outlet end of said adjustable angle adaptive duct section, said flange being curved to fit said upper curved side of said elbow portion of said rectangular cross section distribution duct, said mounting flange being generally perpendicular to each of the plurality of walls of the outlet section and to one of the walls of the inlet section.

2. The improvement according to claim 1 wherein said bendable means comprises a single continuous sheet of material.

3. The improvement according to claim 2 wherein said single continuous sheet of material is one piece of sheet metal.

4. The improvement according to claim 1 wherein said means for adapting the outlet end comprises a standard one and one-half inch per foot curved outlet.

* * * * *